United States Patent [19]

Swartz et al.

[11] 4,427,469

[45] Jan. 24, 1984

[54] METHODS OF AND APPARATUS FOR CONTROLLING PLASTIC-TO-CONDUCTOR ADHESION OF PLASTIC-INSULATED, TINNED CONDUCTORS

[75] Inventors: Raymond K. Swartz, Lilburn, Ga.; Horst L. Woellner, Omaha, Nebr.

[73] Assignee: Western Electric Co., Inc., New York, N.Y.

[21] Appl. No.: 442,823

[22] Filed: Nov. 18, 1982

Related U.S. Application Data

[63] Continuation of Ser. No. 237,182, Feb. 23, 1981, abandoned.

[51] Int. Cl.[3] ..... H01B 13/06

[52] U.S. Cl. ..... 156/50; 156/51; 29/825; 148/11.5 Q; 427/120; 427/299; 427/357; 427/405; 427/409

[58] Field of Search ..... 427/118, 120, 357, 299, 427/405, 409; 148/11.5 Q; 156/50, 51; 29/825

[56] References Cited

U.S. PATENT DOCUMENTS

| | | | |
|---|---|---|---|
| 494,667 | 4/1893 | Clamer | 427/357 |
| 1,626,713 | 5/1927 | Alexander et al. | 148/11.5 |
| 1,653,378 | 12/1927 | Steel | 148/11.5 Q |
| 1,993,400 | 3/1935 | Convers | 148/20 |
| 2,026,605 | 1/1936 | Antisell | 148/11.5 Q |
| 2,057,582 | 10/1936 | McKean et al. | 206/3 |
| 2,080,518 | 5/1937 | Underwood | 427/357 |
| 2,176,583 | 10/1939 | Cook | 266/104 |
| 2,283,798 | 5/1942 | Delano | 432/59 |
| 2,320,412 | 6/1943 | Cook | 205/16 |
| 2,398,034 | 4/1946 | Oganowski | 427/357 |
| 2,667,429 | 1/1954 | Diffenderfer | 427/357 |
| 3,540,918 | 11/1970 | Trattner et al. | 117/102 |
| 3,826,690 | 7/1974 | Bleinberger et al. | 148/11.5 |

*Primary Examiner*—Norman Morgenstern
*Assistant Examiner*—Richard Bueker
*Attorney, Agent, or Firm*—E. W. Somers

[57] ABSTRACT

A tinned conductor is advanced through each of a plurality of successively smaller die openings in a drawing apparatus to reduce the diameter of the tinned conductor after which it is annealed. After the tinned conductor has been annealed, it is moved through the opening of a die which is slightly smaller than the final die opening in the drawing apparatus. This reconfigures any of the tin coating that may have reflowed during annealing and formed protrusions to remove any such protrusions and form an essentially smooth surface. As a result, the adhesion of a subsequently extruded plastic covering to the tinned conductor is controlled to be within a predetermined range and to be substantially uniform along the length of the conductor.

3 Claims, 7 Drawing Figures

Fig. 3
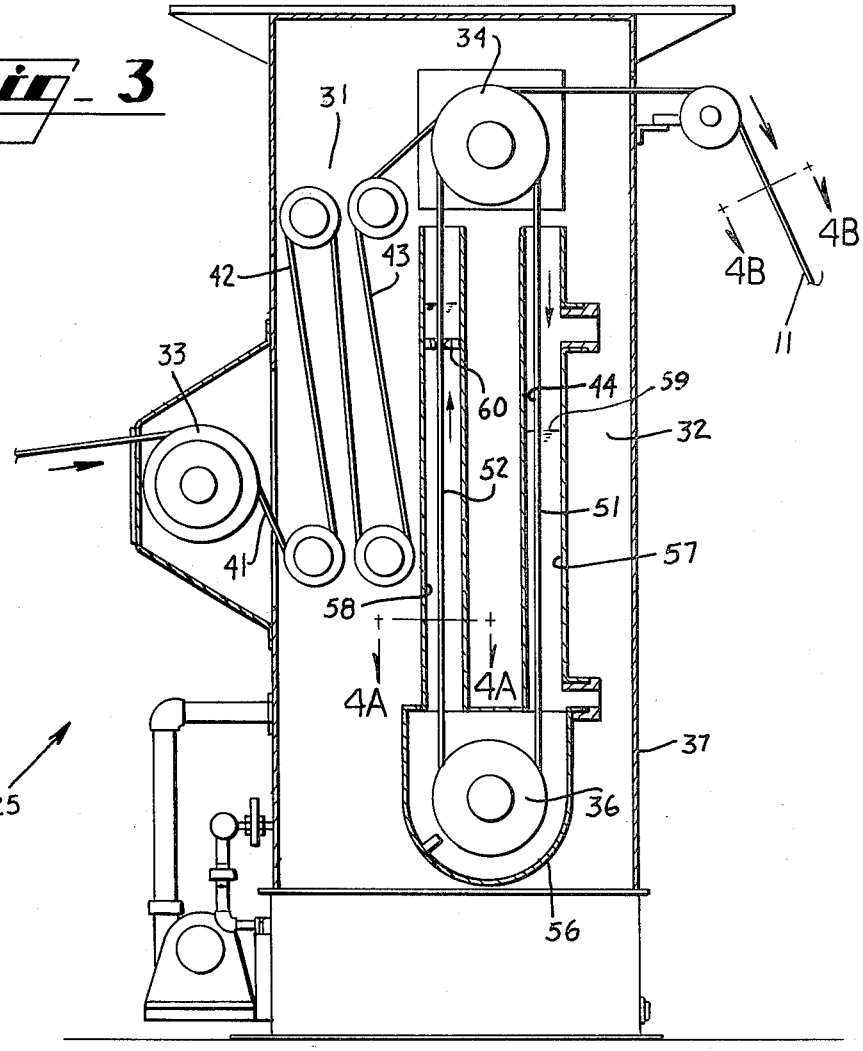
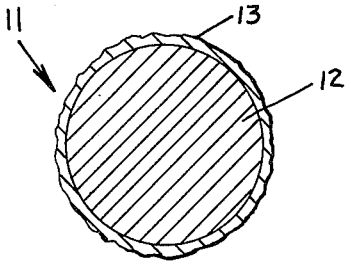
Fig. 4A
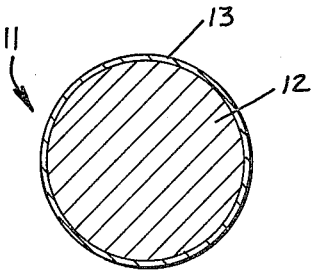
Fig. 4B

METHODS OF AND APPARATUS FOR CONTROLLING PLASTIC-TO-CONDUCTOR ADHESION OF PLASTIC-INSULATED, TINNED CONDUCTORS

This is a continuation of application Ser. No. 237,182 filed Feb. 23, 1981, now abandoned.

TECHNICAL FIELD

This invention relates to methods of and apparatus for controlling the plastic-to-conductor adhesion of plastic-insulated tinned conductors. More particularly, it relates to methods of and apparatus for making conductors which are tinned prior to being drawn and annealed and which have a substantially smooth outwardly facing surface in order to achieve a substantially predetermined insulation-to-conductor adhesion which is substantially uniform along the length of the conductor.

BACKGROUND OF THE INVENTION

Tinned insulated conductors are commonplace in the telecommunications industry. Their use in the field involves the step of stripping their insulation covers with the tin coating remaining to facilitate soldering operations. The tin coating is also helpful in establishing a gas tight seal when a tinned conductor is wrapped about a terminal. Because the tin coating is relatively soft, it also forms a compliant mechanical bond with the terminal in a wire-wrapped connection.

Typically, the metallic portion of the insulated conductor is tinned, then drawn and then heat-treated by annealing prior to insulating in order to cause the metallic conductor to have particular properties. When the metallic conductor has been tinned prior to draw, it is commonly referred to as a pre-tinned conductor. Whenever a pre-tinned conductor is annealed, the relatively high temperature of annealing causes the tin coating to soften which results in an irregular outer surface on the conductor. Because of the irregular interface between the insulation and the conductor, the plastic insulation is caused to have an undesirably high adhesion to the conductor. As one can imagine, this causes problems for installers wishing to strip the insulation to make connections in the field.

The last-mentioned problem becomes aggravated when the final product is one in which the plastic insulation has been irradiation cross-linked after it has been extruded over the wire. For a discussion of irradiation cross-linked insulation and apparatus for making same, see U.S. Pat. No. 3,925,671, which issued in the names of J. R. Austin et al on Dec. 9, 1975 and U.S. Pat. No. 3,623,940 which issued in the names of H. M. Gladstone et al on Nov. 30, 1971.

As a result of crosslinking, the plastic contracts about the conductor and provides additional adhesion over that obtained with non-cross-linked plastic on a conductor having a smooth, unroughened outer surface. When the plastic insulation over pre-tinned conductors is cross-linked, the increase in adhesion which is normally provided by the cross-linking is accentuated.

Not only can the present process result in excessively high insulation-to-conductor adhesion values, but also in ones that are not uniform along the length of the conductor. This can lead to misleading test results and/or require additional field time in discarding those portions of insulated conductors which may have unacceptably high values.

Seemingly, the prior art does not offer a solution to this problem. Nevertheless, a solution is required if the industry is to be able to reap the benefits such as reduced size and improved mechanical properties of an irradiation cross-linked insulation, and yet not impair the strippability of the insulation from its substrate conductor.

SUMMARY OF THE INVENTION

The foregoing problems of the prior art have been overcome by the methods and apparatus of this invention in which a tin-coated conductor which is destined to be covered with a plastic insulation is advanced in a path from a supply through a draw apparatus in which the diameter of the coated conductor is reduced in a plurality of steps. The outside diameter of the drawn, tinned conductor is provided by a final die in the path of the conductor in the draw apparatus, said final die being referred to as a finishing die.

Then the drawn, tinned conductor is moved through an annealer in which the temperature of the conductor is raised to be within a range of predetermined values. The heating of the tinned conductor in the annealer is accomplished at a temperature which exceeds the melting point of the tin coating. As a result, there is an amount of reflowing of the tin on the conductor surface as the conductor is moved through the annealer and this causes tin protrusions to be formed.

In order to remove the protrusions, the annealer is provided with a wiping die adjacent to a point at which the conductor exits the annealer. The wiping die is sized so that it has an opening which is only slightly greater than the diameter of the tinned conductor at that point and which is only slightly less than the opening of the finishing die in the draw apparatus. These relative dimensions of the finishing and wiper dies are required in order to take into account the slight reduction in size of the tinned conductor in the annealer caused by elongation. Moreover, the control of the wiping die relative to the diameter of the tinned conductor avoids any draw of the conductor as it is moved through the wiping die.

The wiping die is effective to mechanically reconfigure the outer surface of the tinned conductor to remove any irregularities in the tin coating and provide a substantially smooth surface. The reconfiguring is effective to cause the tin which forms the protrusions to fill any depressions in the coating.

From the wiping die at the exit end of the annealer, the conductor is moved through a crosshead of an extruder in which a plastic insulation cover is applied over the conductor. The insulated conductor is advanced into, through and then out of a cooling trough after which it is taken up and in some instances moved to other apparatus where it is irradiation cross-linked.

BRIEF DESCRIPTION OF THE DRAWNGS

Other features of the present invention will be more readily understood from the following detailed description of specific embodiments thereof when read in conjunction with accompanying drawings, in which.

Figure 1:
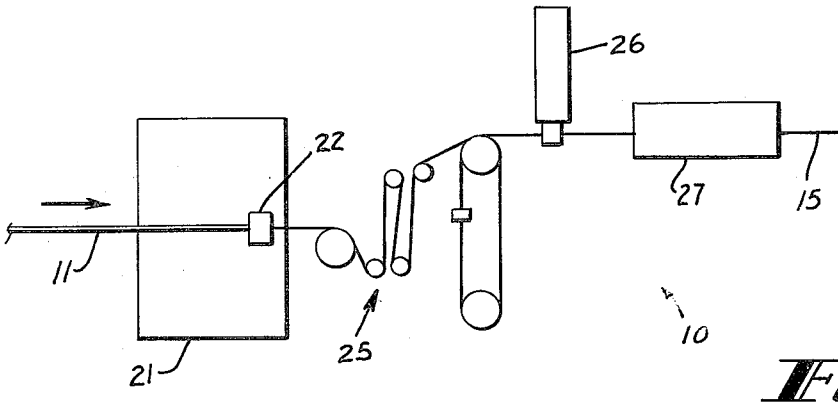
FIG. 1 is a schematic view of a manufacturing line on which a pretinned conductor is drawn, annealed and insulated.
Figure 5:
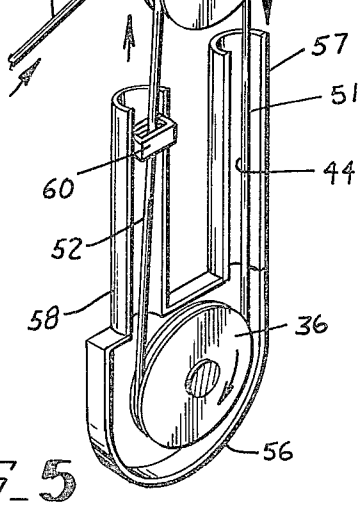
Figure 6:
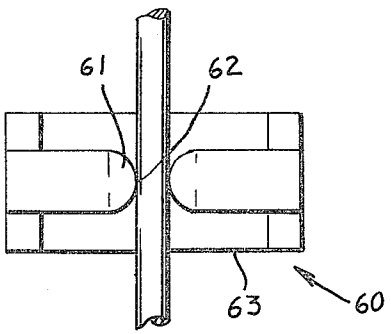

FIG. 3 is an elevational view of an annealer which is included in the line of FIG. 1 and which includes a wiping die of this invention; and FIGS. 4A and 4B are end views of a pre-tinned conductor after being advanced through a heating leg of the annealer and after having been advanced through the wiping die at the exit end of the annealer; and FIG. 5 is a perspective view of heating and cooling legs of the annealer which is shown in FIG. 3 to show the wiping die; and FIG. 6 is an enlarged end view of the conductor as it is moved through the wiping die at the exit end of the annealer of FIG. 3.

DETAILED DESCRIPTION

Figure 2:
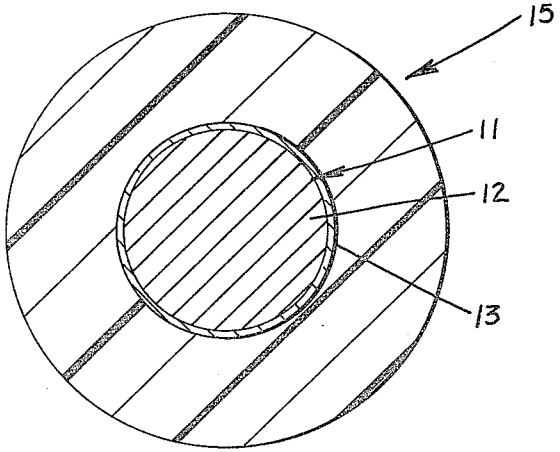
FIG. 2 is an end view of an insulated conductor which is made with the apparatus of this invention.

Referring now to FIG. 1, there is shown a schematic view of a manufacturing line, which is designated generally by the numeral 10, for insulating a tinned conductor 11. The tinned conductor 11 generally includes a copper conductor 12 having a tin layer 13 coated thereover (see FIG. 2). Typically, the tin is coated over the copper conductor to provide a total tin cover of about 0.39 milligrams per square centimeter. The melting point of the copper conductor is in the range of about 1083° C. while that of tin is about 232° C. The apparatus 10 is used to draw, anneal and then insulate the tinned conductor 11 with a plastic material such as polyvinyl chloride (PVC) to provide an insulated conductor 15. As was noted hereinbefore, the conductor 12 is referred to as a pre-tinned conductor since it has been tinned prior to draw.

Successive increments of the conductor 11 are advanced from a supply through a drawing apparatus 21 which includes a plurality of dies having successively smaller openings to reduce the outer diameter of the pre-tinned conductor. A final die 22 in the drawing apparatus 21 is referred to as a finishing die and provides a conductor having the required gauge size for insulating.

From the drawing apparatus 21, the conductor 11 is moved through an annealer, which is designated by the numeral 25, wherein the conductor is heat treated to cause the conductor to have particular properties. The annealed conductor 11 is moved through an extruder 26 where a layer of plastic insulation is applied over the tinned conductor after which the insulated conductor 15 is moved through a water trough 27 by a capstan 28 and taken up on a reel 29. The drawing apparatus 21, the extruder 26, the water trough 28 and the capstan 29 are conventional apparatus and are well known in the art. However, the annealer 25 of this invention causes the subsequently applied insulation to have an adhesion to the pre-tinned conductor which is within a predetermined range and moreover is one whch is substantially uniform along the length of the conductor.

The annealer 25 is a resistance annealer in which electrical current is caused to flow through the metallic conductor 11 which is being advanced through the annealer. As can be seen in FIG. 3, the annealer 25 includes a pre-annealer portion 31 and a main annealer portion 32. The annealer 25 includes a grooved sheave 33 which is positioned just prior to an entrance of the conductor 11 into the pre-annealer portion 31. Also, there is a sheave 34 at the top of the main annealer 32 and a second grooved sheave 36 at a lower end 37 of the annealer. The electrical current which is passed through the conductor 11 causes the temperature of the conductor to be raised to about the range of 371° to 482° C.

As can be seen in the drawings, the conductor 11 is advanced through several loops 41, 42 and 43 in the pre-annealer portion 31 and through one loop 44 which extends between the sheave 34 and the grooved sheave 36. Approximately 40% of the length of the conductor in the annealer 25 is in the main portion thereof with about 60% being within the pre-annealer portion 31. Since the amount of current in each portion is inversely proportional to the conductor length in each portion, about 60% of the current is in the main annealer portion and 40% in the pre-annealer portion.

The annealer 25 includes a heating leg or run 51 which occurs as the conductor 11 is advanced downwardly between the sheave 34 and the lower grooved sheave 36. A cooling leg or run 52 extends between the lower grooved sheave 36 and its upper sheave 34. Portions of the cooling leg 52 and the heating leg 51 are filled with a cooling medium such as chilled water at a predetermined temperature or a water-soluble oil mixture.

As can be seen in the drawings, the tinned conductor 11 is advanced through a container 56 between the heating leg 51 and the cooling leg 52. The container 56 is a water jacket which is used to quench the annealed conductor along the heating leg 51. The engagement of the conductor 11 at the abovementioned temperature and the water in the container 56 results in the formation of steam which flows upwardly in a tube 57 which encloses the heating leg 51. The steam encloses the conductor 11 being advanced downwardly and is effective to prevent oxidation of the heated conductor 11.

It should be observed that the heating leg tube 57, the water pocket container 56 and the cooling leg tube 58 are all interconnected so that the level of the cooling medium rises in the heating tube. The level 59 of the water in the heating leg 57 of the annealer 25 controls the point at which the metal which comprises the conductor 12 is quenched. This in turn affects the properties of the annealed conductor.

The apparatus 10 is designed to match the desired elongation, the resistance and the diameter of the annealed conductor 11. Care must be taken not to overanneal the conductor 11 which would result in excessive elongation values. The matching of the parameters is accomplished from measured values of parameters such as amperes of current in the heating leg 51. The control of these parameters is important particularly in view of the line speeds at which the conductor is advanced e.g. 18 to 25 m/sec.

Inasmuch as the conductor is heated during the annealing, some of the tin coating is driven into an intermetallic alloy (see D. A. Unsworth and C. A. Machay "A Preliminary Report On Growth of Compound Layers On Various Metal Bases Plated With Tin and Its Alloys" a paper presented at the CDA-ASM Conference on Copper in October 1972 in Cleveland, Ohio). The portion of the tin which forms the intermetallic alloy is of no benefit in wire wrapping and in establishing a compliant electrical connection with terminal pins.

In order to insure that adequate tin remains on the surface of the conductor, the quantity of tin coating is specified both in amounts of total tin and of free tin. Free tin is defined as that amount of tin remaining after a portion of the initial total amount has gone into the intermetallic alloy. Typical requirements include a minimum of 0.31 milligrams/cm$^2$ and a maximum of 0.62 milligrams/cm$^2$ of free tin with the total tin being in the range of 0.36 to 0.93 milligrams/cm$^2$.

The heating of the conductor 11 in the leg 51 of the annealer 25 which is dependent on line speed and time within the annealer is accomplished in a temperature range of about 371° C. to 482° C. This causes the tin which it will be recalled has a melting point in the range of about 232° C. to flow to some degree and to reform, disadvantageously with an irreglar profile (see FIG. 4A). This profile provides a surface area which is increased over that of an unroughened surface and provides undesirably high adhesion values of the subsequently extruded insulation to the conductor 11. The increased adhesion causes problems for a user such as for example an installer who under field conditions wishes to strip the insulation from end portions of lengths of the conductor 15 to make connections.

The annealer 25 of this invention overcomes this problem and provides an annealed conductor 11 with which the insulation will have a controlled adhesion, both as to value and as to uniformity along the conductor. This is accomplished by providing the annealer with a wiping die 60 (see FIGS. 5 and 6) which is positioned adjacent to an exit end of the cooling leg 52 and slightly below the level of the cooling medium. The wiping die 60 includes a diamond die 61 having an opening 62 with the die being mounted in a holder 63.

The size of the opening 62 is slightly larger than a specified diameter of the annealed tin covered conductor 11. For example, the size of the opening is in the range of about 0.00025 to 0.0005 cm larger than the outer diameter of the tinned conductor 11. As a result, the wiping die 60 is effective to mechanically reconfigure the outer surface of the tin coating after the heating run 51 whereat the tin has reflowed to cause the tin coating to have a substantially smooth surface.

The sizing of the wiping die 60 is critical from several standpoints. First it must be matched with the finishing die 22 on the draw apparatus 21 so that it is slightly smaller than that die. The finishing die 22 and the wiper die 60 form a matched set and must be used in combination to assure the correct sequence. While the opening 62 in the wiping die 60 is slightly smaller than the opening in the finishing die 22 of the draw apparatus 21, it is still slightly larger than the diameter of the tinned conductor 11 within the cooling leg of the annealer. The reason for this is that the tinned conductor 11 is caused to elongate under the influence of heat in the annealer with an accompanying slight reduction in diameter over that which it had at the finishing die 22.

The diameter of the wiping die 60 is also important in order to avoid causing excessive drag on the tinned conductor 11. This would result in unduly high line tension and cause conductor breaks thereby necessitating down time and restringing. Moreover, if a relatively small opening 61 were used, the surface speed of the top sheave 34 in the main portion of the annealer would have to be increased over that of the lower sheave 36 in order to overcome these drag forces.

The sizing of the wiping die 60 is important from still another standpoint. The insulated conductor 15 which is produced by the apparatus 10 of this invention, perhaps in combination with irradiation cross-linking equipment (not shown), may be used for wiring within telephone central offices as loose wire or as part of a cable. For each type of insulated conductor 15, there is a requirement regarding the percent of the outer surface area of the metallic conductor 12 which is covered with tin. If the opening 61 in the wiping die 60 were too small, not only would excessive drag forces be imparted to the conductor, but an undue amount of tin could be removed which may detract from that coverage.

EXAMPLE

A 26 AWG copper conductor 11 was annealed and insulated with on irradiation cross-linkable polyvinyl chloride (PVC) plastic material having a thickness of about 0.03 cm. The adhesion of the plastic to the conductor 11 was measured to be about 317.5 grams. A 26 AWG copper conductor 11 having a tin coating of about 0.93 milligrams/square centimeter but not annealed was insulated with the same plastic material and found to have a plastic-to-conductoradhesion of about 653.2 grams. Then a 26 AWG copper conductor 11 having the same tin coating was annealed to a conductor elongation of 21% and insulated with a 0.03 cm thick wall of plastic. This last example exhibited a plastic-to-conductor adhesion of about 1419.7 grams.

In accordance with this invention, a 26 AWG copper conductor exiting from a 0.0414 cm. finishing die 22 in a drawing apparatus 21 and having a total tin coating of 0.93 milligrams/square centimeter was annealed to an elongation of 21%. The annealed tinned conductor was advanced through a wiping die 60 having an opening of 0.0409 cm., covered with a plastic insulation having a 0.03 cm. wall thickness, cooled and taken up. The adhesion of the plastic to the conductor was measured to be 898.1 grams.

It is to be understood that the above-described arrangements are simply illustrative of the invention. Other arrangements may be devised by those skilled in the art which will embody the principles of the invention and fall within the spirit and scope thereof.

What is claimed is:

1. A method of making an insulated conductor having a metallic coating between a conductor and an insulative cover wherein the coating has a substantially smooth outer surface and a controlled adhesion to the insulative cover, said method comprising the steps of:

moving an elongated conductor having a circular crosssection along a path of travel, said conductor being made of a first metallic material and being covered with a coating of a second metallic material which has a melting point that is substantially less than that of the first metallic and which has a thickness that is substantially less than the diameter of the conductor;

drawing the coated conductor to reduce its diameter; annealing the drawn coated conductor by heating the coated conductor to increase substantially its temperature and by cooling the coated conductor, the temperature to which the coated conductor is heated causing said coating to reflow and roughen the outer surface of the coated conductor; then reshaping the coating on the annealed conductor without changing the cross-sectioned area of the conductor by passing the conductor through the opening of a die after it has been heated and after it has been cooled to provide a coated conductor having a substantially smooth outer surface;

covering the coated conductor with a plastic insulation material to form an insulative cover having a thickness which is substantially greater than that of said second metallic material and having an adhesion to said outer surface of said coated conductor which is within a predetermined range of values and which is substantially uniform along the length of the conductor; and taking up the insulated conductor wherein the step of reshaping the metal coating with said die removes protrusions which would otherwise cause undesirably strong and nonuniform adhesion between said outer surface and said insulative cover.

2. The method of claim 1 wherein said step of drawing the coated conductor is accomplished by advancing the conductor through a plurality of successively smaller die openings to reduce the diameter of the conductor to a predetermined value prior to the step of annealing the conductor, and wherein the final die opening through which the conductor is advanced during the step of drawing the conductor is slightly greater than the opening through which the conductor is advanced during said reshaping step.

3. The method of claim 1, wherein said step of reshaping is accomplished with a die opening having a diameter which is slightly greater than the diameter of the annealed coated conductor.

* * * * *